US011760448B2

(12) United States Patent
Long

(10) Patent No.: US 11,760,448 B2
(45) Date of Patent: Sep. 19, 2023

(54) WATERCRAFT FENDER WITH LOCKING SUCTION MECHANISMS

(71) Applicant: Okoboji Coast, LLC, Spirit Lake, IA (US)

(72) Inventor: Carlie Long, North Sioux City, SD (US)

(73) Assignee: Okoboji Coast, LLC, Spirit Lake, IA (US)

( * ) Notice: Subject to any disclaimer, the term of this patent is extended or adjusted under 35 U.S.C. 154(b) by 115 days.

(21) Appl. No.: 17/341,506

(22) Filed: Jun. 8, 2021

(65) Prior Publication Data

US 2021/0380206 A1 Dec. 9, 2021

Related U.S. Application Data

(60) Provisional application No. 63/036,135, filed on Jun. 8, 2020.

(51) Int. Cl.
*B63B 59/02* (2006.01)

(52) U.S. Cl.
CPC ..... *B63B 59/02* (2013.01)

(58) Field of Classification Search
CPC ..... B63B 59/00; B63B 59/02; B63B 21/00; B63B 21/20
USPC ..... 114/219
See application file for complete search history.

(56) References Cited

U.S. PATENT DOCUMENTS 5,048,446 A * 9/1991 Powell ..... B63B 59/02 114/219
5,560,312 A 10/1996 McPherson
5,697,316 A * 12/1997 Kinkead ..... B63B 59/02 114/219
5,732,645 A * 3/1998 Lemke ..... B63B 59/02 114/219
7,377,227 B2 * 5/2008 LaRoche ..... B63B 21/22 114/294
9,199,696 B1 * 12/2015 Bonell ..... B63B 21/20
(Continued)

FOREIGN PATENT DOCUMENTS

FR 2805220 A1 8/2001
KR 20130002898 U 5/2013

OTHER PUBLICATIONS

International Patent Application No. PCT/US2021/036290, International Search Report and Written Opinion dated Sep. 30, 2021, 14 pages.

*Primary Examiner* — Lars A Olson

(74) *Attorney, Agent, or Firm* — Fredrikson & Byron, P.A.

(57) ABSTRACT

A protective fender for a watercraft includes a plurality of attachment mechanisms configured to secure the protective fender to an exterior portion of the watercraft. The protective fender further includes a fender body, wherein a first surface of the fender body that contacts the exterior portion of the watercraft comprises a smooth surface. The protective fender also includes a plurality of adjustable-length straps. A first adjustable-length strap secures an upper-left quadrant of the fender body upwards to a first attachment mechanism of the plurality of attachment mechanisms, and a second adjustable-length strap secures an upper-right quadrant of the fender body upwards to a second attachment mechanism of the plurality of attachment mechanisms.

21 Claims, 5 Drawing Sheets

(56) References Cited

U.S. PATENT DOCUMENTS

| | | | | |
|---|---|---|---|---|
| 2006/0220400 | A1 | 10/2006 | Diamond | |
| 2012/0118770 | A1 * | 5/2012 | Valls | F16M 13/00 248/688 |

* cited by examiner

WATERCRAFT FENDER WITH LOCKING SUCTION MECHANISMS

PRIORITY CLAIM

This application claims priority to U.S. provisional patent application No. 63/036,135, filed Jun. 8, 2020, the entire contents of which are incorporated herein.

TECHNICAL FIELD

The disclosure relates to watercraft protection devices.

BACKGROUND

Unlike land vehicles, watercrafts have the inherent issue of being forced to dock on unstable water when the boat is parked, stored, or when passengers wish to board or exit the watercraft. These docks typically have cleats or posts which the watercraft can connect to via dock ropes, but the waves in the water can still push the watercraft into the dock, potentially damaging the watercraft. Watercrafts generally have cleats to which rubber, inflatable bumpers can be attached in an effort to protect the watercraft, but the presence of other watercrafts on the dock and the physical location of the dock posts and cleats in relation to the watercraft can cause the bumpers to be in an improper location for the purposes of protecting the watercraft. Watercrafts may also include rub rails designed to protect the watercraft, but these rub rails can become damaged themselves over time, limiting their benefit after sustaining damage.

SUMMARY

In one example, the disclosure is directed to a protective fender for a watercraft. The protective fender includes a plurality of locking suction mechanisms configured to secure the protective fender to an exterior portion of the watercraft. The protective fender further includes a fender body, wherein a first surface of the fender body that contacts the exterior portion of the watercraft comprises a smooth surface. The protective fender also includes plurality of adjustable-length straps, wherein a first adjustable-length strap secures an upper-left quadrant of the fender body upwards to a first locking suction mechanism of the plurality of locking suction mechanisms, and wherein a second adjustable-length strap secures an upper-right quadrant of the fender body upwards to a second locking suction mechanism of the plurality of locking suction mechanisms.

In another example, the disclosure is directed to a method of installing a protective fender. The method includes cleaning a surface of an exterior portion of a watercraft. The method also includes placing a first locking suction mechanism of a plurality of locking suction mechanisms at a first location on the surface of the exterior portion of the watercraft. The method further includes placing a second locking suction mechanism of the plurality of locking suction mechanisms at a second location on the surface of the exterior portion of the watercraft. The method also includes activating a lever on each of the first locking suction mechanism and the second locking suction mechanism to secure the first locking suction mechanism and the second locking suction mechanism to the first location and the second location, respectively. The method further includes adjusting a length of a first adjustable-length strap and a length of a second adjustable-length strap such that a fender body of the protective fender covers at least a portion of a rub rail attached to the surface of the exterior portion of the watercraft.

The details of one or more examples of the disclosure are set forth in the accompanying drawings and the description below. Other features, objects, and advantages of the disclosure will be apparent from the description and drawings, and from the claims.

DETAILED DESCRIPTION

Figure 1:
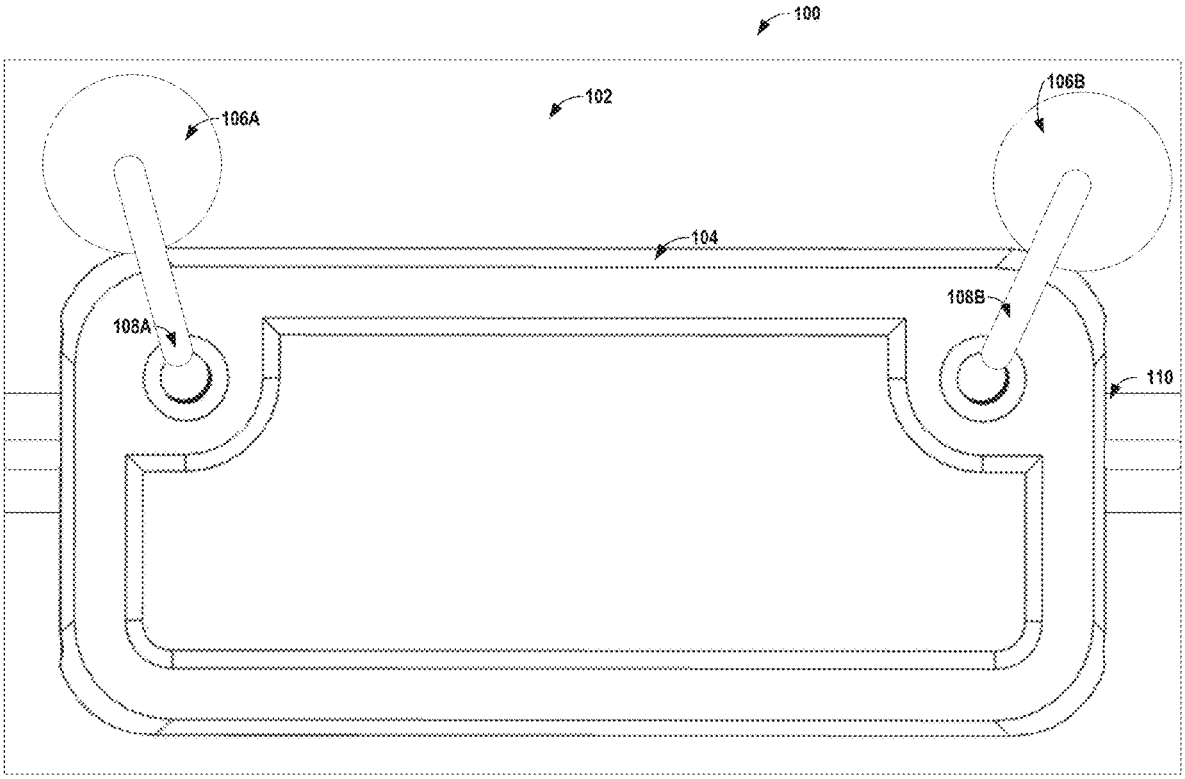
FIG. 1 is a perspective diagram illustrating an example protective fender attached to a watercraft in accordance with one or more aspects of the current disclosure.

FIG. 1 is a perspective diagram illustrating an example protective fender 100 attached to watercraft 102 in accordance with one or more aspects of the current disclosure. Protective fender 100, also referred to herein as a fender system, may include fender body 104, locking suction mechanisms 106A and 106B, and adjustable-length straps 108A and 108B. Protective fender 100 may be configured to attach to an exterior of watercraft 102 to protect at least a portion of the exterior of watercraft 102, such as an exterior wall or rub rail 110.

Watercraft 102 may be any type of watercraft that would be docked in a body of water, such as a man-powered boat, a sailboat, a motorboat, a ski boat, and/or a personal watercraft. Watercraft 102 may be made out of any number of materials, including fiberglass, wood, or metal, among other things. In some instances, watercraft 102 may include rub rail 110, although protective fender 100 may also be used on to protect exterior portions of watercrafts that do not include a rub rail. Rub rail 110 may be made of a metal or rubber material and may be designed to provide a final level of protection for the exterior portion of 102.

Protective fender 100 includes locking suction mechanisms 106A and 106B. Each of locking suction mechanisms 106A and 106B may be configured to secure protective fender 100 to an exterior portion of watercraft 100. For the purposes of this disclosure, locking suction mechanisms 106A and 106B may be any mechanism that securely attaches protective fender 100 to watercraft 102 in a way that also enables protective fender to be removed, relocated, and reattached without placing holes in watercraft 102 and without damaging watercraft 102.

In the examples of FIGS. 1-4, locking suction mechanisms 106A and 106B are shown to have a particular structure, although other structures with similar functionality may be used in place of locking suction mechanisms 106A and 106B. In the instance of FIG. 1, locking mechanisms 106A and 106B may include a suction cup. A first surface of the suction cup, or the concave portion of the suction cup, is configured to be secured against the exterior portion of watercraft 102. For best use, the suction cup will most securely attach to the exterior portion of watercraft 102 if the exterior portion is first cleaned, although the suction cup may still attach to the exterior portion of watercraft 102 if the exterior portion is not clean.

Each of locking suction mechanisms 106A and 106B may also include a casing covering a second surface of the suction cup, or the convex portion of the suction cup. In some examples, the casing is a hard plastic material, although other materials, such as rubber, soft plastic, or metal, may also be used to construct the casing.

Each of locking suction mechanisms 106A and 106B may also include a lever. The lever may be made of a hard plastic material, a rubber material, a soft plastic material, or a metal material. When the lever is in a first position, the casing is pressed against the suction cup to engage the concave surface of the suction cup to the exterior portion of watercraft 102, thereby securing locking suction mechanism 106A or 106B to the exterior portion of watercraft 102. When the lever is in a second position, the casing is lifted away from the suction cup, thereby releasing a connection between the suction cup and the exterior portion of watercraft 102. This enables a user to move and place protective fender 100 in the optimal position based on the environment in which watercraft 102 will be docked.

Protective fender 100 may also include fender body 104. A first surface of fender body 104, when installed on watercraft 102, contacts the exterior portion of watercraft 102. In some instances, the first surface may be a smooth surface, although the first surface may also be textured in other instances.

As shown in FIG. 1, fender body 104, when secured to watercraft 102 via locking suction mechanisms 106A and 106B, covers at least a portion of rub rail 110 attached to the exterior portion of watercraft 102. In doing so, fender body 104 may provide protection to rub rail 110 in addition to the hull of watercraft 102, placing a protective layer between the dock and rub rail 110.

In some instances, fender body 104 may be composed of a foam material. For instance, the foam material comprises an aqua closed-cell foam material. Aqua closed-cell foam is a durable, lightweight, closed-cell polyvinyl chloride foam that has particular thermal, chemical, and physical properties that are viable solutions for a variety of applications, including padding for large vehicles such as watercrafts. However, in other instances, fender body 104 may be composed of another protective material, including rubber, silicon, or plastic, that will not scratch or damage watercraft 102 upon contact. Furthermore, fender body 104 may be made of multiple materials, wherein at least the first surface contact watercraft 102 is made of the foam or other protective material and wherein the opposite surface is made of another material, such as wood, plastic, or metal.

Fender body 104 may also have a customizable appearance. For instance, the protective material (e.g., the foam or aqua closed-cell foam) may be produced in a variety of textures, colors, sizes, or superimposed graphics such that the outward aesthetic appearance of fender body 104 is able to be custom produced by the manufacturer or user of protective fender 100.

In some instances, fender body 104 has a horizontal length that is greater than a vertical length of fender body 104. In other words, fender body 104 extends further along watercraft 102 from bow to stern than it extends along the height of the hell of watercraft 102. In this way, fender body 104 provides a greater contact surface along the length of watercraft 102 without having to be moved around the exterior of watercraft 102.

Protective fender 100 also includes adjustable-length straps 108A and 108B. In the example of FIG. 1, adjustable-length strap 108A secures an upper-left quadrant of fender body 104 upwards to locking suction mechanism 106A, and adjustable-length strap 108B secures an upper-right quadrant of fender body 104 upwards to locking suction mechanism 106B of the plurality of locking suction mechanisms.

Although the example of FIG. 1 shows a locking suction mechanism, other attachment mechanisms may be used. For instance, in lieu of locking suction mechanisms, adjustable-length straps 108A and 108B may, on each end, include one portion of a buckle clip. In such instances, the buckle clips may snap together to form a full loop for adjustable-lengths straps 108A and 108B, with the loop wrapping around a cleat or other fixture on the interior or exterior of watercraft 102. In still other instances, the attachment mechanism may be sewing or sealing two ends of a strap permanently together to form the same loop as shown above with the buckle clip. In still other instances, the attachment mechanism may be a knot formed by ends of adjustable-length straps 108A and/or 108B.

Adjustable-length straps 108A and 108B may be adjustable by a number of means. In some instances, adjustable-length straps 108A and 108B are adjustable by respective adjustment mechanisms incorporated into each of locking suction mechanisms 106A and 106B. Each adjustment mechanism would be configured to adjust the length of the respective adjustable-length strap 108A or 108B secured to the respective locking suction mechanism 106A and 106B. These adjustment mechanisms may include ratchets, clips, or adjustable slides, among other things. In some of these instances, adjustable length straps 108A and 108B may be a simple nylon strap, though adjustable length straps 108A and 108B may also be made of other materials, such as Cordura, canvas, sailcloth, perlon, or any other material suitable for nautical purposes.

In other examples, adjustable length straps 108A and 108B are nylon-webbed hook-and-loop straps (e.g., Velcro® straps). In this instance, adjustment mechanisms may simply include a loop which adjustable length straps 108A and 108B loop around, with the adjustment occurring by the user in securing the nylon-webbed hook-and-loop strap to itself.

Protective fender 100 provides numerous benefits. Firstly, protective fender 100 provides extended surface area coverage, thereby limiting the available points of contact for watercraft 102 with a docking system at which watercraft 102 is parking. Secondly, protective fender 100 allows the user to place fender body 104 at the location of his or her choosing with locking suction mechanisms 106A and 106B. Locking suction mechanisms 106A and 106B eliminate the necessity for the cleats typically found on the exterior of watercrafts and allows the user to place protective fender 100 at the exact location on the hull needed to protect the hull from damage. Additionally, locking suction mechanisms 106A and 106B locking capability allows protective fender 100 to withstand friction and weight when in use and also prevents protective fender 100 from swaying or shifting.

Figure 2:
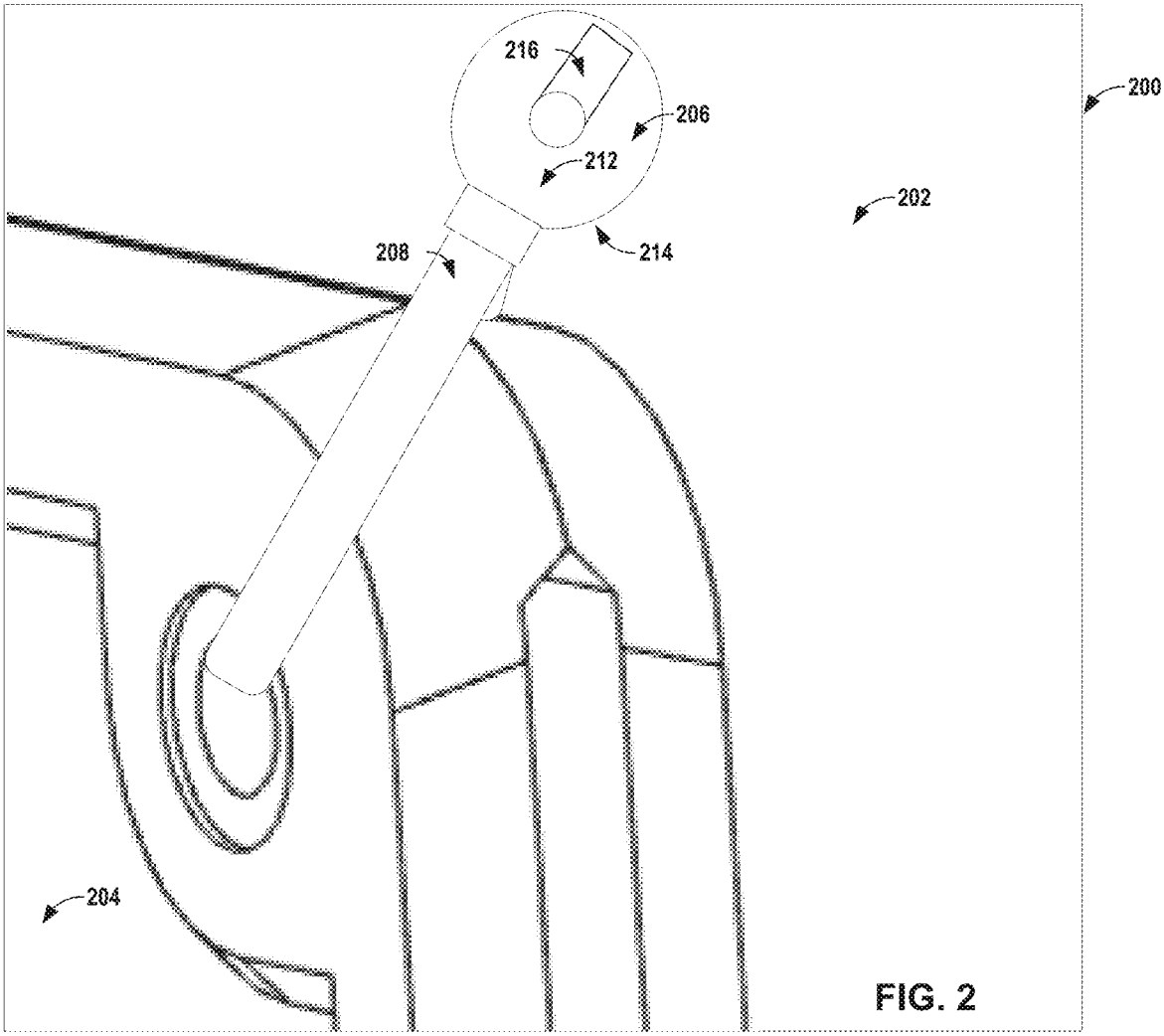
FIG. 2 is a perspective diagram illustrating a more detailed example of a locking suction mechanism configured to secure a fender body to a watercraft in accordance with one or more aspects of the current disclosure.

FIG. 2 is a perspective diagram illustrating a more detailed example of locking suction mechanism 206 configured to secure fender body 204 to watercraft 202 in accordance with one or more aspects of the current disclosure. In the example of FIG. 2, the similarly named and labeled structures may have a similar structure, function, and composition to the corresponding structures of FIG. 1. For instance, watercraft 202 may be structurally, functionally, and compositionally similar to watercraft 102 of FIG. 1. Fender body 204 may be structurally, functionally, and compositionally similar to fender body 104 of FIG. 1. Locking suction mechanism 206 may be structurally, functionally, and compositionally similar to locking suction mechanisms 106A and 106B of FIG. 1. Adjustable-length strap 208 may be structurally, functionally, and compositionally similar to adjustable length-straps 108A and 108B of FIG. 1. Rub rail 210 may be structurally, functionally, and compositionally similar to rub rail 110 of FIG. 1.

In the example of FIG. 2, the structures of locking suction mechanism 206 (e.g., casing 212, suction cup 214, and lever 216) are more clearly depicted. In the instance of FIG. 2, locking mechanism 206 includes suction cup 214, which is shown engaged with the exterior of watercraft 202. A first surface of suction cup 214, or the concave portion of the suction cup, is configured to be secured against the exterior portion of watercraft 202. For best use, suction cup 214 will most securely attach to the exterior portion of watercraft 202 if the exterior portion is first cleaned, although suction cup 214 may still attach to the exterior portion of watercraft 102 if the exterior portion is not clean.

Locking suction mechanisms 206A and 106B may also include casing 212. Casing 212 covers a second surface of suction cup 214, or the convex portion of suction cup 214. In some examples, casing 212 is a hard plastic material, although other materials, such as rubber, soft plastic, or metal, may also be used to construct casing 212.

Locking suction mechanism 206 also includes lever 216. Lever 216 may be made of a hard plastic material, a rubber material, a soft plastic material, or a metal material. When lever 216 is in a first position, such as the position shown in FIG. 2, casing 212 is pressed against suction cup 214 to engage the concave surface of suction cup 214 to the exterior portion of watercraft 202, thereby securing locking suction mechanism 206 to the exterior portion of watercraft 202. When lever 216 is in a second position (actuated from the position shown in FIG. 2), casing 212 is lifted away from suction cup 214, thereby releasing a connection between suction cup 214 and the exterior portion of watercraft 202. This enables a user to move and place protective fender 200 in the optimal position based on the environment in which watercraft 202 will be docked.

Figure 3:
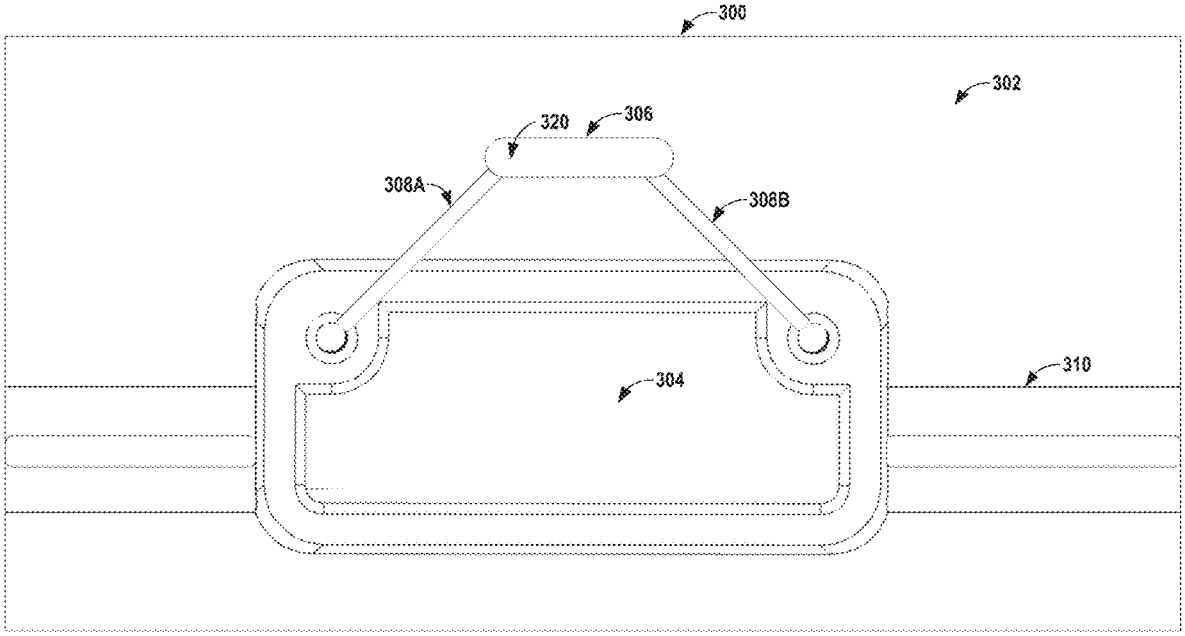
FIG. 3 is a perspective diagram illustrating an example protective fender attached to a rear portion of a watercraft in accordance with one or more aspects of the current disclosure.

FIG. 3 is a perspective diagram illustrating an example protective fender 300 attached to a rear portion of watercraft 302 in accordance with one or more aspects of the current disclosure. In the example of FIG. 3, the similarly named and labeled structures may have a similar structure, function, and composition to the corresponding structures of FIG. 1. For instance, watercraft 302 may be structurally, functionally, and compositionally similar to watercraft 102 of FIG. 1. Fender body 304 may be structurally, functionally, and compositionally similar to fender body 104 of FIG. 1. Adjustable-length straps 308A and 308B may be structurally, functionally, and compositionally similar to adjustable length-straps 108A and 108B of FIG. 1. Rub rail 310 may be structurally, functionally, and compositionally similar to rub rail 110 of FIG. 1.

As shown in FIG. 3, protective fender 300 is installed towards the stern of watercraft 302. In this way, protective fender 300 may be installed anywhere along the perimeter of watercraft 302, thereby being located in the optimal position for the environment in which watercraft 302 is docking.

Additionally, rather than the locking suction mechanisms of FIG. 1, protective fender 300 is shown with attachment mechanism 306 attaching adjustable length strap 308A and adjustable length strap 308B. In this instance, attachment mechanism 306 may be a buckle clip. One half of attachment mechanism 306 may be attached to adjustable length strap 308A, which is secured to a hole in fender body 304. Similarly, a second half of attachment mechanism 306 may be attached to adjustable length strap 308B, which is secured to a different hole in fender body 304. When the two halves of attachment mechanism 306 are connected, fender body 304 may hang from a fixture on an interior or exterior of watercraft 302, such as cleat 320. In other examples, attachment mechanism 306 may be a locking suction mechanism, such as locking suction mechanism 206 of FIG. 2, such that fender body 304 may be placed anywhere along an exterior of watercraft 302 rather than nearby cleat 320.

Figure 4:
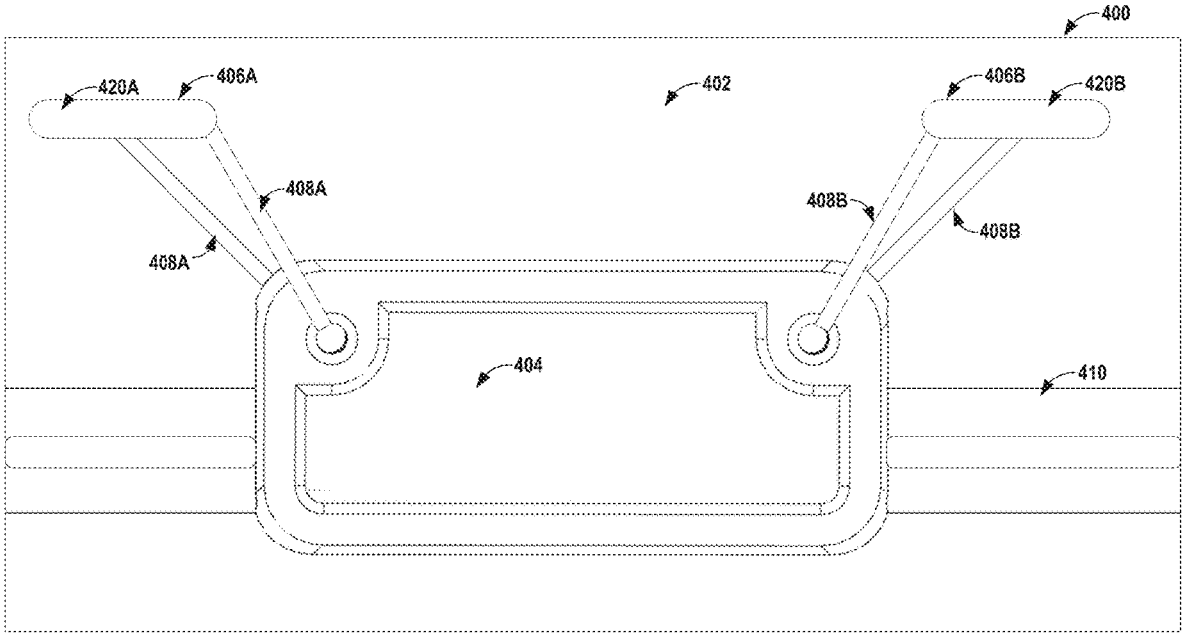
FIG. 4 is a perspective diagram illustrating an example protective fender attached to a different style of watercraft than the watercraft of FIGS. 1-3, in accordance with one or more aspects of the current disclosure.

FIG. 4 is a perspective diagram illustrating an example protective fender attached to a different style of watercraft than the watercraft of FIGS. 1-3, in accordance with one or more aspects of the current disclosure. In the example of FIG. 3, the similarly named and labeled structures may have a similar structure, function, and composition to the corresponding structures of FIG. 1. For instance, watercraft 402 may be structurally, functionally, and compositionally similar to watercraft 102 of FIG. 1. Fender body 404 may be structurally, functionally, and compositionally similar to fender body 104 of FIG. 1. Adjustable-length straps 408A and 408B may be structurally, functionally, and compositionally similar to adjustable length-straps 108A and 108B of FIG. 1. Rub rail 410 may be structurally, functionally, and compositionally similar to rub rail 110 of FIG. 1.

While watercrafts 102, 202, and 302 of FIGS. 1, 2, and 3, respectively, show a smaller watercraft, such as a small motor-powered watercraft or a personal watercraft, watercraft 402 is shown to be a larger such as an outboard bowrider boat or a deckboat. In this way, protective fender 400 may be installed in any number of environments and on any number of watercrafts while still providing similar protective value and functionality for the respective watercraft. Given the larger size of watercraft 402, watercraft 402 may include two cleats, 420A and 420B, to provide more points where boating items may be secured to a body of watercraft 402.

Additionally, rather than the locking suction mechanisms of FIG. 1, protective fender 400 is shown with attachment mechanisms 406A and 406B attaching different halves of adjustable length strap 408A and adjustable length strap 408B, respectively. In this instance, attachment mechanisms 406A and 406B may be a buckle clip. One half of attachment mechanism 406A may be attached to a first half of adjustable length strap 408A, which loops through a hole in fender body 304. A second half of adjustable length strap 408A is attached to a second half of attachment mechanism 406A. When the two halves of attachment mechanism 406A are connected, fender body 404 may at least partially hang from a fixture on an interior or exterior of watercraft 402, such as cleat 420A.

Similarly, one half of attachment mechanism 406B may be attached to a first half of adjustable length strap 40BA, which loops through a different hole in fender body 404. A second half of adjustable length strap 408B is attached to a second half of attachment mechanism 406B. When the two halves of attachment mechanism 406B are connected, fender body 404 may at least partially hang from a fixture on an interior or exterior of watercraft 402, such as cleat 420B.

In other examples, attachment mechanisms 406A and 406B may each be a locking suction mechanism, such as locking suction mechanism 206 of FIG. 2, such that fender body 404 may be placed anywhere along an exterior of watercraft 402 rather than nearby cleats 420A and 420B.

Additional depictions of watercraft 102 of FIG. 1, watercraft 202 of FIG. 2, watercraft 302 of FIG. 3, and watercraft 402 of FIG. 4, with examples of the protective fenders described herein, are shown in the figures of the provisional application from which this disclosure claims priority (i.e., U.S. provisional patent application No. 63/036,135, filed Jun. 8, 2020, the entire contents of which are incorporated herein).

Figure 5:
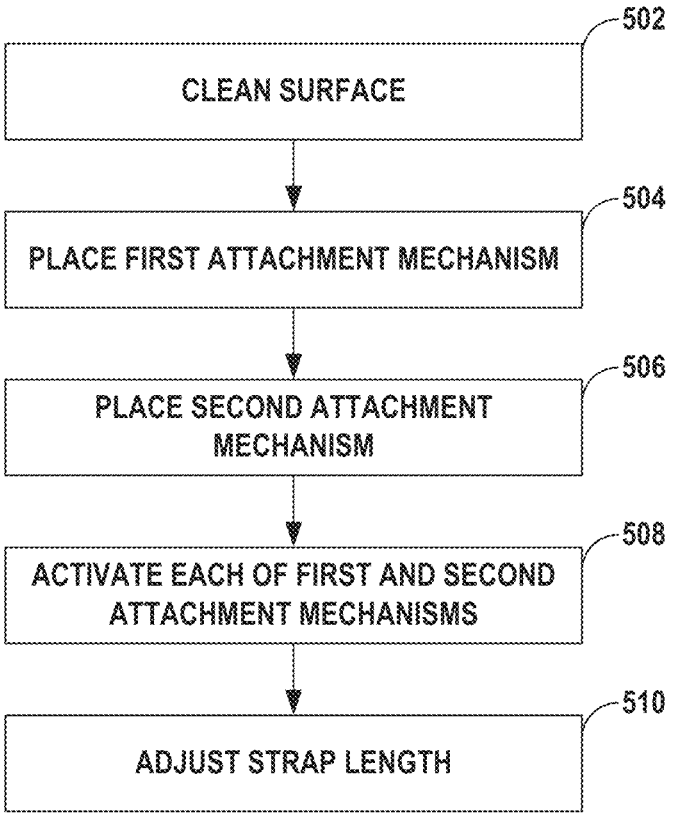
FIG. 5 is a flow diagram illustrating an example installation process for a protective fender in accordance with one or more aspects of the current disclosure.

FIG. 5 is a flow chart illustrating an example process for installing a fender system in accordance with one or more aspects of the current disclosure. The techniques of FIG. 5 may be performed utilizing any of the fender systems described herein, such as fender system 100 of FIG. 1, fender system 200 of FIG. 2, fender system 300 of FIG. 3, and/or fender system 400 of FIG. 4. For purposes of illustration only, the techniques of FIG. 5 are described within the context of fender system 100 of FIG. 1, although fender systems having configurations different than that of fender system 100 may be utilized to perform the techniques of FIG. 5.

In accordance with the techniques described herein, the first installation step includes cleaning a surface of an exterior portion of watercraft 102 (502). The installation process also includes placing a first attachment mechanism (e.g., a locking suction mechanism, a buckle mechanism, such as a side release buckle, or any other mechanism that may attach a protective fender to a watercraft) of the plurality of attachment mechanisms at a first location on the surface of the exterior portion of watercraft 102 (504). The installation process further includes placing a second attachment mechanism (e.g., a locking suction mechanism, a buckle mechanism, such as a side release buckle, or any other mechanism that may attach a protective fender to a watercraft) of the plurality of attachment mechanisms at a second location on the surface of the exterior portion of watercraft 102 (506). The installation process also includes activating each of the first attachment mechanism and the second attachment mechanism, either after each individual attachment mechanism is placed or after both attachment mechanisms are placed, to secure the first attachment mechanism and the second attachment mechanism to the first location and the second location, respectively (508). The installation process also includes adjusting a length of first adjustable-length strap 108A and a length of second adjustable-length strap 108B such that fender body 104 of fender system 100 covers at least a portion of rub rail 110 attached to the surface of the exterior portion of watercraft 102 (510).

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently.

Various examples of the disclosure have been described. Any combination of the described systems, operations, or functions is contemplated. These and other examples are within the scope of the following claims.

What is claimed is:

1. A protective fender for a watercraft, the protective fender comprising:

a plurality of attachment mechanisms configured to secure the protective fender to an exterior portion of the watercraft;

a fender body, wherein a first surface of the fender body contacts the exterior portion of the watercraft; and a plurality of adjustable-length straps, wherein a first adjustable-length strap secures an upper-left quadrant of the fender body upwards to a first attachment mechanism of the plurality of attachment mechanisms, and wherein a second adjustable-length strap secures an upper-right quadrant of the fender body upwards to a second attachment mechanism of the plurality of attachment mechanisms, wherein the first attachment mechanism comprises a first half of a buckle clip, and wherein the second attachment mechanism comprises a second half of the buckle clip, wherein the first half of the buckle clip attaches to the second half of the buckle clip.

2. The protective fender of claim 1, further comprising a plurality of adjustment mechanisms, each adjustment mechanism being attached to a respective one of the plurality of locking suction mechanisms, and wherein each adjustment mechanism is configured to adjust the length of the respective adjustable-length strap secured to the respective attachment mechanism.

3. The protective fender of claim 1, wherein the fender body, when secured to the watercraft via the plurality of attachment mechanisms, covers at least a portion of a rub rail attached to the exterior portion of the watercraft.

4. The protective fender of claim 1, wherein each of the plurality of adjustable-length straps is made of nylon.

5. The protective fender of claim 1, wherein each of the plurality of adjustable-length straps comprises a nylon-webbed hook-and-loop strap.

6. The protective fender of claim 1, wherein the fender body is composed of a foam material.

7. The protective fender of claim 6, wherein the foam material comprises an aqua closed-cell foam material.

8. The protective fender of claim 1, wherein the fender body has a customizable appearance.

9. The protective fender of claim 1, wherein the fender body has a horizontal length that is greater than a vertical length of the fender body, and wherein the first surface of the fender body comprises a smooth surface.

10. A system comprising:

a watercraft; and a protective fender comprising:

a plurality of attachment mechanisms configured to secure the protective fender to an exterior portion of the watercraft, wherein each attachment mechanism of the plurality of attachment mechanisms comprises a locking suction mechanism, and wherein each locking suction mechanism comprises:

a suction cup, wherein a first surface of the suction cup is configured to be secured against the exterior portion of the watercraft;

a casing covering a second surface of the suction cup; and a lever, wherein, when the lever is in a first position, the casing is pressed against the suction cup to engage the suction cup to the exterior portion of the watercraft, and wherein, when the lever is in a second position, the casing is lifted away from the suction cup, thereby releasing a connection between the suction cup and the exterior portion of the watercraft;

a fender body, wherein a first surface of the fender body contacts the exterior portion of the watercraft; and a plurality of adjustable-length straps, wherein a first adjustable-length strap secures an upper-left quadrant of the fender body upwards to a first attachment mechanism of the plurality of attachment mechanisms, and wherein a second adjustable-length strap secures an upper-right quadrant of the fender body upwards to a second attachment mechanism of the plurality of attachment mechanisms.

11. The system of claim 10, wherein the watercraft comprises one or more of a man-powered boat, a sailboat, a motorboat, a ski boat, and a personal watercraft.

12. The system of claim 10, wherein the protective fender further comprises a plurality of adjustment mechanisms, each adjustment mechanism being attached to a respective one of the plurality of locking suction mechanisms, and wherein each adjustment mechanism is configured to adjust the length of the respective adjustable-length strap secured to the respective attachment mechanism.

13. A protective fender for a watercraft, the protective fender comprising:

a plurality of attachment mechanisms configured to secure the protective fender to an exterior portion of the watercraft, wherein each attachment mechanism of the plurality of attachment mechanisms comprises a locking suction mechanism, wherein each locking suction mechanism comprises:

a suction cup, wherein a first surface of the suction cup is configured to be secured against the exterior portion of the watercraft;

a casing covering a second surface of the suction cup; and a lever, wherein, when the lever is in a first position, the casing is pressed against the suction cup to engage the suction cup to the exterior portion of the watercraft, and wherein, when the lever is in a second position, the casing is lifted away from the suction cup, thereby releasing a connection between the suction cup and the exterior portion of the watercraft;

a fender body, wherein a first surface of the fender body contacts the exterior portion of the watercraft; and a plurality of adjustable-length straps, wherein a first adjustable-length strap secures an upper-left quadrant of the fender body upwards to a first attachment mechanism of the plurality of attachment mechanisms, and wherein a second adjustable-length strap secures an upper-right quadrant of the fender body upwards to a second attachment mechanism of the plurality of attachment mechanisms.

14. The protective fender of claim 13, further comprising a plurality of adjustment mechanisms, each adjustment mechanism being attached to a respective one of the plurality of locking suction mechanisms, and wherein each adjustment mechanism is configured to adjust the length of the respective adjustable-length strap secured to the respective attachment mechanism.

15. The protective fender of claim 13, wherein the fender body, when secured to the watercraft via the plurality of attachment mechanisms, covers at least a portion of a rub rail attached to the exterior portion of the watercraft.

16. The protective fender of claim 13, wherein each of the plurality of adjustable-length straps is made of nylon.

17. The protective fender of claim 13, wherein each of the plurality of adjustable-length straps comprises a nylon-webbed hook-and-loop strap.

18. The protective fender of claim 13, wherein the fender body is composed of a foam material.

19. The protective fender of claim 17, wherein the foam material comprises an aqua closed-cell foam material.

20. The protective fender of claim 13, wherein the fender body has a customizable appearance.

21. The protective fender of claim 13, wherein the fender body has a horizontal length that is greater than a vertical length of the fender body, and wherein the first surface of the fender body comprises a smooth surface.

* * * * *